US009551357B2

(12) United States Patent
Waller

(10) Patent No.: US 9,551,357 B2
(45) Date of Patent: Jan. 24, 2017

(54) OIL MANAGEMENT SYSTEM FOR A COMPRESSOR

(71) Applicant: Emerson Climate Technologies GmbH, Waiblingen (DE)

(72) Inventor: Barry Granville Waller, West Perth (AU)

(73) Assignee: Emerson Climate Technologies GmbH, Waiblingen (DE)

( * ) Notice: Subject to any disclaimer, the term of this patent is extended or adjusted under 35 U.S.C. 154(b) by 671 days.

(21) Appl. No.: 13/664,805

(22) Filed: Oct. 31, 2012

(65) Prior Publication Data

US 2013/0115063 A1 May 9, 2013

(30) Foreign Application Priority Data

Nov. 4, 2011 (AU) ..... 2011904589

(51) Int. Cl.

| | |
|---|---|
| ***F25B 31/00*** | (2006.01) |
| ***F01D 5/08*** | (2006.01) |
| ***F04D 29/58*** | (2006.01) |
| ***F04B 39/02*** | (2006.01) |

(52) U.S. Cl.

CPC ..... *F04D 29/582* (2013.01); *F04B 39/0207* (2013.01); *F25B 31/002* (2013.01); *F25B 2400/01* (2013.01); *F25B 2500/31* (2013.01)

(58) Field of Classification Search

CPC . F25B 31/002; F25B 2400/01; F25B 2500/16; F25B 2700/193; F25B 2700/21152; F25B 2700/21155

USPC ..... 62/193; 415/177

See application file for complete search history.

(56) References Cited

U.S. PATENT DOCUMENTS

| | | | | |
|---|---|---|---|---|
| 2,107,887 A | | 2/1938 | Davenport | |
| 3,133,429 A | | 5/1964 | Griffin | |
| 3,208,237 A | | 9/1965 | Gerteis | |
| 3,577,741 A | | 5/1971 | Shaw | |
| 3,705,499 A | | 12/1972 | Mount et al. | |
| 4,066,869 A | * | 1/1978 | Apaloo et al. | 219/490 |
| 4,208,883 A | | 6/1980 | Stirling | |
| 4,236,379 A | | 12/1980 | Mueller | |

(Continued)

FOREIGN PATENT DOCUMENTS

| | | | |
|---|---|---|---|
| CN | 1391060 | A | 1/2003 |
| CN | 101116232 | A | 1/2008 |

(Continued)

OTHER PUBLICATIONS

International Search Report regarding Application No. PCT/US2010/050109, mailed May 3, 2011.

(Continued)

*Primary Examiner* — Henry Crenshaw

(74) *Attorney, Agent, or Firm* — Harness, Dickey & Pierce, P.L.C.

(57) ABSTRACT

The invention relates to an oil management system for a compressor in a refrigeration system comprising: an oil temperature sensor; a heater arranged to heat oil in a crank case of the compressor; and a controller operatively associated with the temperature sensor and the heater, the controller arranged to control operation of the heater on the basis of ambient air temperature and oil temperature to maintain the oil temperature within a range Tmax≥R≥Tmin where Tmax>Tmin.

8 Claims, 2 Drawing Sheets

(56) References Cited

U.S. PATENT DOCUMENTS

| | | | | |
|---|---|---|---|---|
| 4,490,988 | A | 1/1985 | Vogel et al. | |
| 4,605,831 | A * | 8/1986 | Mitchell | 200/83 R |
| 5,012,652 | A * | 5/1991 | Dudley | 62/192 |
| 5,052,897 | A | 10/1991 | Yamashita et al. | |
| 5,054,293 | A | 10/1991 | Schwecke | |
| 5,062,217 | A | 11/1991 | Tolson | |
| 5,230,222 | A | 7/1993 | Erbs | |
| 5,369,958 | A | 12/1994 | Kasai et al. | |
| 5,577,390 | A * | 11/1996 | Kaido | F04B 25/005 236/1 EA |
| 6,017,205 | A * | 1/2000 | Weatherston | F04C 18/0215 184/6 |
| 6,523,361 | B2 | 2/2003 | Higashiyama | |
| 6,591,621 | B2 | 7/2003 | Loprete et al. | |
| 6,834,513 | B2 | 12/2004 | O'Brien et al. | |
| 6,848,268 | B1 * | 2/2005 | Memory et al. | 62/513 |
| 6,886,354 | B2 | 5/2005 | Dudley | |
| 6,904,759 | B2 | 6/2005 | Shoulders | |
| 7,096,681 | B2 | 8/2006 | Wills et al. | |
| 7,290,990 | B2 | 11/2007 | Lifson | |
| 7,331,187 | B2 * | 2/2008 | Kates | 62/129 |
| 7,797,084 | B2 | 9/2010 | Miwa | |
| 2002/0018724 | A1 | 2/2002 | Millet et al. | |
| 2002/0020175 | A1 * | 2/2002 | Street et al. | 62/132 |
| 2002/0129612 | A1 | 9/2002 | Saikusa et al. | |
| 2003/0213256 | A1 * | 11/2003 | Ueda | F25B 1/02 62/230 |
| 2004/0068387 | A1 * | 4/2004 | Bonanni et al. | 702/138 |
| 2004/0083731 | A1 * | 5/2004 | Lasker | 60/645 |
| 2004/0211193 | A1 * | 10/2004 | Van der Walt et al. | 62/62 |
| 2005/0126171 | A1 * | 6/2005 | Lasker | 60/645 |
| 2005/0188708 | A1 | 9/2005 | Wills et al. | |
| 2005/0248456 | A1 * | 11/2005 | Britton, Jr. | G06Q 10/08 340/539.29 |
| 2006/0070398 | A1 | 4/2006 | De Bernardi et al. | |
| 2007/0006608 | A1 * | 1/2007 | Lee | 62/468 |
| 2008/0245083 | A1 * | 10/2008 | Tutunoglu et al. | 62/115 |
| 2009/0324427 | A1 | 12/2009 | Tolbert, Jr. et al. | |
| 2010/0254832 | A1 | 10/2010 | Nakazawa | |
| 2010/0254834 | A1 | 10/2010 | Tolbert, Jr. | |
| 2010/0278660 | A1 | 11/2010 | Burchill et al. | |
| 2011/0070100 | A1 | 3/2011 | McSweeney et al. | |
| 2011/0083450 | A1 | 4/2011 | Turner et al. | |
| 2012/0227430 | A1 | 9/2012 | Takeuchi et al. | |

FOREIGN PATENT DOCUMENTS

| | | | |
|---|---|---|---|
| CN | 101319818 | A | 12/2008 |
| CN | 101392745 | A | 3/2009 |
| CN | 102679507 | A | 9/2012 |
| CN | 102725600 | A | 10/2012 |
| EP | 0546982 | A1 | 6/1993 |
| JP | 6116278 | | 1/1986 |
| JP | 61016278 | | 1/1986 |
| JP | 10009685 | | 1/1998 |
| WO | WO-2009095989 | A1 | 8/2009 |
| WO | WO-2009096620 | A1 | 8/2009 |
| WO | WO-2009096923 | A1 | 8/2009 |
| WO | WO-2012125891 | A2 | 9/2012 |

OTHER PUBLICATIONS

Non-Final Office Action regarding U.S. Appl. No. 12/888,823, dated Jun. 11, 2013.

Written Opinion of the International Searching Authority regarding Application No. PCT/US2010/050109, mailed May 3, 2011.

Extended European Search Report regarding Application No. 12187632.0-1602 / 2589898, dated Dec. 13, 2013.

International Search Report regarding Application No. PCT/US2013/070082, dated Feb. 20, 2014.

Written Opinion of the International Searching Authority for PCT/US2013/070082, mailed Feb. 20, 2014.

International Search Report regarding Application No. PCT/US2014/056120, mailed Dec. 17, 2014.

Written Opinion of the International Searching Authority regarding Application No. PCT/US2014/056120, mailed Dec. 17, 2014.

First Chinese Office Action regarding Application No. 201210436480.7, dated Dec. 26, 2014. Translation obtained from espacenet.com.

Examiner-Initiated Interview Summary regarding Application No. 14/079,271, dated Sep. 16, 2015.

First Office Action and Search Report from State Intellectual Property Office of People's Republic of China regarding Chinese Patent Application No. 201080042651.7, dated Jan. 15, 2014. Translation provided by Unitalen at Law.

International Search Report regarding Application No. PCT/US2013/070082, mailed Feb. 20, 2014.

Office Action regarding Chinese Patent Application No. 201410545027.9, dated Jan. 28, 2016. Translation provided by Unitalen Attorneys at Law.

Written Opinion of International Searching Authority regarding Application No. PCT/US2013/070082, mailed Feb. 20, 2014.

Office Action regarding Chinese Patent Application No. 201380060117.2, dated May 25, 2016. Translation provided by Unitalen Attorneys at Law.

Search Report regarding European Patent Application No. 13854340.0, dated Jun. 17, 2016.

Final Office Action for U.S. Appl. No. 13/664,805 mailed Jun. 13, 2016.

* cited by examiner

OIL MANAGEMENT SYSTEM FOR A COMPRESSOR

CROSS-REFERENCE TO RELATED APPLICATIONS

This application claims the benefit of Australian Patent Application No. 2011904589, filed Nov. 4, 2011. The disclosure of the above application is incorporated herein by reference in its entirety.

FIELD

An oil management system and method are disclosed for a compressor in a refrigeration system.

BACKGROUND

In a refrigeration system a compressor is used to produce a high refrigerant pressure gas which is subsequently liquefied by a condenser. The compressor has moving parts which must be lubricated in order to ensure reliable operation and longevity. Oil which is delivered to the moving parts of the compressor collects in a bottom of a compressor crank case and is recirculated: by a pump, or by refrigerant gas circulation through compressor, to the moving parts.

A crank case heater is sometimes used to heat the oil during a cycle OFF mode of the refrigeration system. This keeps the oil warm and prevents refrigerant migrating back to the crank case. In addition in cooler weather conditions, heating the oil maintains a minimum viscosity which assists in ensuring the quick application of lubricant to moving parts upon the refrigeration system switching to a cycle ON mode.

Oil management systems for compressors are well established in the market. Mechanical systems like the system per example from AC&R Components or the electronic system from per example Henry Technologies or Traxon Industries Pty Ltd.

SUMMARY

In accordance with an aspect of the invention there is provided an oil management system for a compressor in a refrigeration system comprising: an oil temperature sensor; a heater arranged to heat oil in a crank case of the compressor; and, a controller operatively associated with the temperature sensors and the heater, the controller arranged to control operation of the heater on the basis of ambient air temperature and oil temperature to maintain the oil temperature within a range Tmax≥R≥Tmin.

BRIEF DESCRIPTION OF THE DRAWINGS

Embodiments of the invention will now be described, by way of example only, with reference to the accompanying drawings in which.

DETAILED DESCRIPTION

Figure 1:
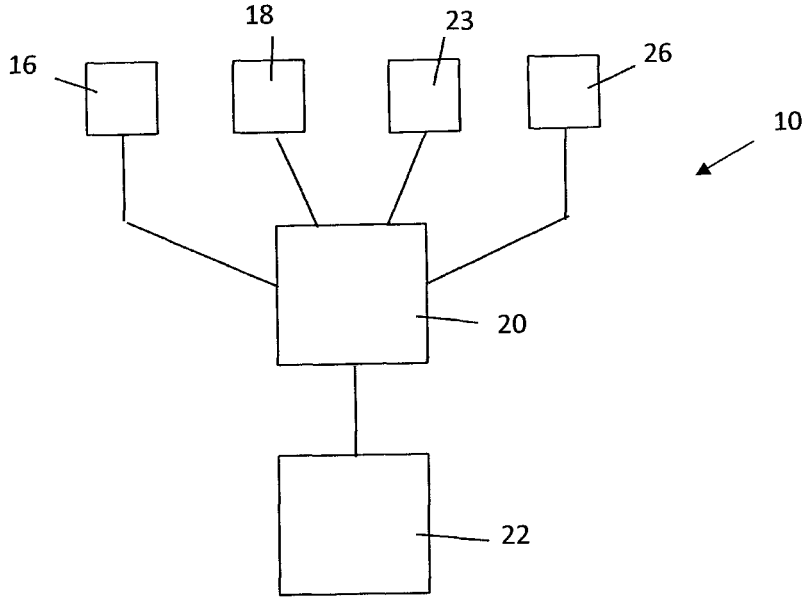
FIG. 1 is a schematic representation of an oil management system in accordance with the present invention.
Figure 2:
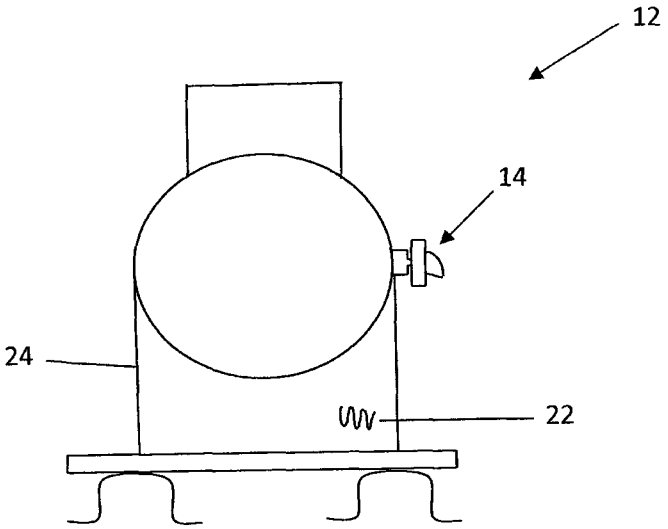
FIG. 2 is a schematic representation of the oil management system in association with a compressor in a refrigeration system.
Figure 3:
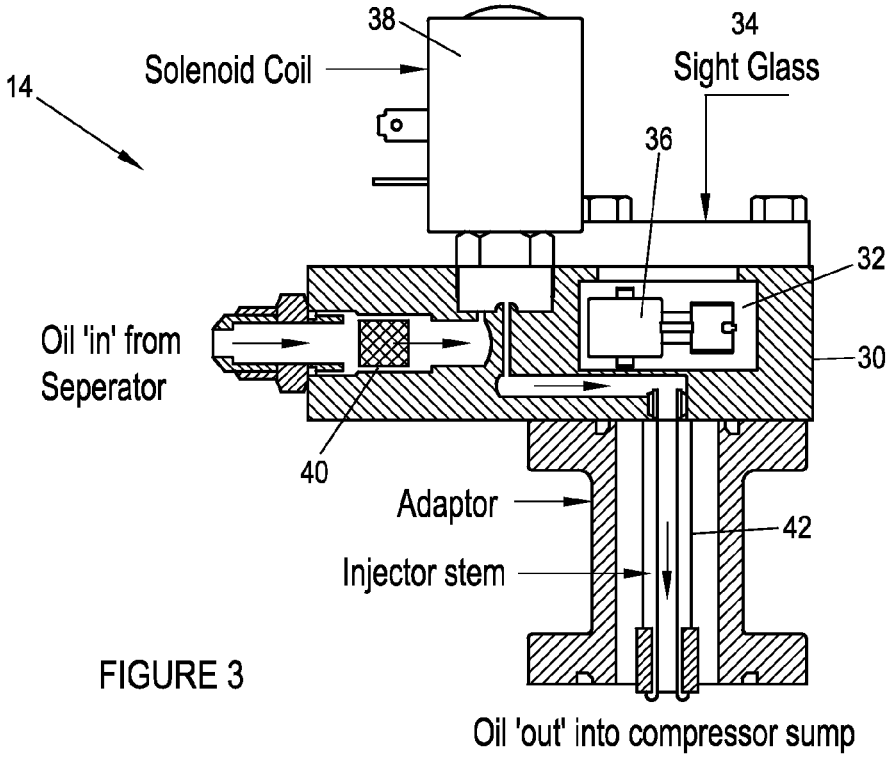
FIG. 3 is a schematic representation of a oil level measuring device which may act as a carrier of components of the oil management system shown in FIG. 1; and, FIG. 4 is a front view of the oil level measuring device and depicting various components of the oil measurement system shown in FIG. 1.

The accompanying figures illustrate an embodiment of an oil management system 10 for a compressor 12. In the present embodiment the oil management system 10 has a number of components which are supported on a compressor oil level sensing device 14. The device 14 is ordinarily coupled to a compressor 12 and the incorporation of components of the oil management system in the oil level sensing system 14 is a matter of convenience. However alternate embodiments are possible where the system 10 comprises a stand alone structure or body supporting one or more of the components of the system 10 and separately associated with the compressor 12.

The illustrated embodiment of the oil management system 10 comprises an oil temperature sensor 18, a controller 20, and a heater 22. The heater 22 can be disposed inside of a crank case 24 of compressor 12.

The oil temperature sensor 18 provides an oil temperature indication to the controller 20. Controller 20 is programmed with an algorithm or look up table to determine from the sensed oil temperature whether or not to turn ON the heater 22. Moreover, the controller is operatively associated with the temperature sensor to control the operation of the heater 22 so as to maintain oil temperature within a prescribed range Tmax≥R≥Tmin. That is, the system 10 operates to maintain the oil temperature in a compressor 12 within a particular limited temperature range.

In a most basic embodiment of system 10 the temperatures Tmin and Tmax can be freely selected by a user of system 10 having regard to the nature of the refrigeration system with which system 10 is to be used and the surrounding environment. The values of Tmin and Tmax are input into the controller 20 or a memory accessed by the controller 20 via an appropriate interface or means. The only limitation in such an embodiment is that Tmax>Tmin.

In more sophisticated embodiments of system 10 the temperature Tmin is based on either saturation temperature of the refrigerant (Tsat), or ambient temperature (Tamb). In particular Tmin≥Tsat or Tmin≥Tamb. That is in one embodiment Tmin is equal to or greater than Tsat, while in an alternate embodiment Tmin is equal to or greater than Tamb. The saturation temperature Tsat is the temperature at which the refrigerant vaporizes at a particular pressure. Maintaining the oil temperature above Tsat will in theory ensure that no refrigerant is carried in the oil. This reduces refrigerant loss in an associated refrigeration system. The oil temperature will be held at the refrigerant temperature until the refrigerant is driven from the oil.

The relationship between Tmin and Tsat or Tamb, can also be rewritten as Tmin=Tsat+ΔT; or Tmin=Tamb+ΔT where ΔT=0° C. to X° C. where X>0.

When Tamb is used in determining Tmin then a corresponding embodiment of system 10 incorporates an ambient temperature sensor 16 to provide to the controller 20 a measure of ambient air temperature (Tamb) of the environment in which the compressor 12 is disposed. When Tsat is used in determining Tmin, the system 10 also incorporates a crank case pressure sensor 23 which measures crank case pressure in crank case 24 of compressor 12. This is provided to the controller 20 which uses this to determine Tsat on the basis of: the general relationship between temperature and pressure; and the type of refrigerant in use and by measuring crank case pressure. In this event the program or look up table used by the controller 20 to determine Tmin is modified to also use the crank case pressure as an input value. For example when the refrigerant is R22 Tsat is 4.4° C. at a pressure of 69 PSIG.

In one embodiment X° C. may be between 0° C. and 2° C. However alternate embodiments are envisaged where X° C. may be higher than 2° C. for example, but not limited to 10° C.

The temperature Tmax is greater than Tmin by an amount that can be either preset in the controller 20 or alternately can be adjusted or varied to meet environmental conditions in which the refrigeration system is located. That is the precise difference between Tmax and Tmin is not critical to the general concept of switching the heater ON when the compressor is OFF to maintain the oil temperature within the range R. Thus in alternate embodiments the difference between Tmax and Tmin can be different. As an example in one embodiment this difference could be 5° K but in another embodiment this difference could be 10° K. In yet a further embodiment this difference could be 20° K.

Generally, when the compressor 12 is in an ON state where the compressor is operating and its parts moving to compress gas, oil is circulated through the compressor 12 and in a relatively short time period will heat to a temperature above the range R. Therefore there is generally no requirement for the controller 20 to activate the heater 22 when the compressor 12 is an ON state. This is particularly the case where the system 10 is operational to ensure that the oil temperature remains within the range R when the compressor is in an OFF state. Thus when the compressor is subsequently switched to an ON state, the oil temperature is already within the prescribed range to ensure proper and speedy lubrication of the moving parts.

Consequently, the system 10 can also incorporate a compressor state sensor 26 which equates to sense the operational state of the compressor 12.

The sensor 26 is arranged to sense an operational state of the compressor 12 and deliver to the controller 20; (a) an OFF state signal when the compressor 12 is sensed as being in the OFF state, and (b) an ON state signal when the compressor 12 is sensed as being in the ON state. Thus when the sensor 26 is incorporated into the system 10 the controller 20 only operates the heater 22 to maintain oil within the prescribed range when the compressor 12 is OFF.

The algorithm used by the controller 20 to maintain oil temperature within a prescribed range R attempts to minimize power usage by comparing oil temperature with air temperature and utilizing natural thermal inertia or hysteresis in the heating or cooling of the oil. Oil temperature signals from the sensors 16 and 18 respectively. If the oil temperature is sensed as being at a level above the range R, and the air temperature is sensed as also being above the level then controller 20 does not turn ON the heater 22.

In the event that the oil temperature is within the prescribed range R and the air temperature is sensed as being below Tmin the controller 20 will commence operation of the heater 22 prior to the oil temperature reaching the level Tmin. This ensures that the oil temperature does not drop below the level Tmin. The controller 20 will determine when to commence operation of the heater 22 by reference to the algorithm and stored data which takes into account factors such as the thermal inertia of the oil and the compressor 12 and crank case 24; the difference between the sensed air temperature and oil temperature; the rate of decrease in oil temperature; and, the rate at which the heater 22, when operated, heats the oil.

In the event that the air temperature is above Tmax and the oil temperature is within the range R or exceeds the temperature Tmax, then controller 20 again does not turn ON the heater 22.

In a scenario where air temperature is greater than Tmax and the oil temperature is below the range R, then in one embodiment the controller 20 utilizing its control algorithm will operate to turn ON the heater 22 but subsequently turn OFF the heater when the oil temperature senses reaching the minimum temperature Tmin. From there, further increasing oil temperature is achieved through natural heat exchange with the environment.

The oil management system 10 operates to minimize energy usage of the heater 22 to hold the oil temperature at least at or above the temperature Tmin, and to ensure that no power is provided to the heater 22 when oil temperature is within the range R and air temperature is sensed as being at least above the temperature Tmax. Thus for example in a warm climate where air temperature is often above the temperature Tmax, the system 10 would rarely operate to boost oil temperature to fall within the range R.

Figure 4:
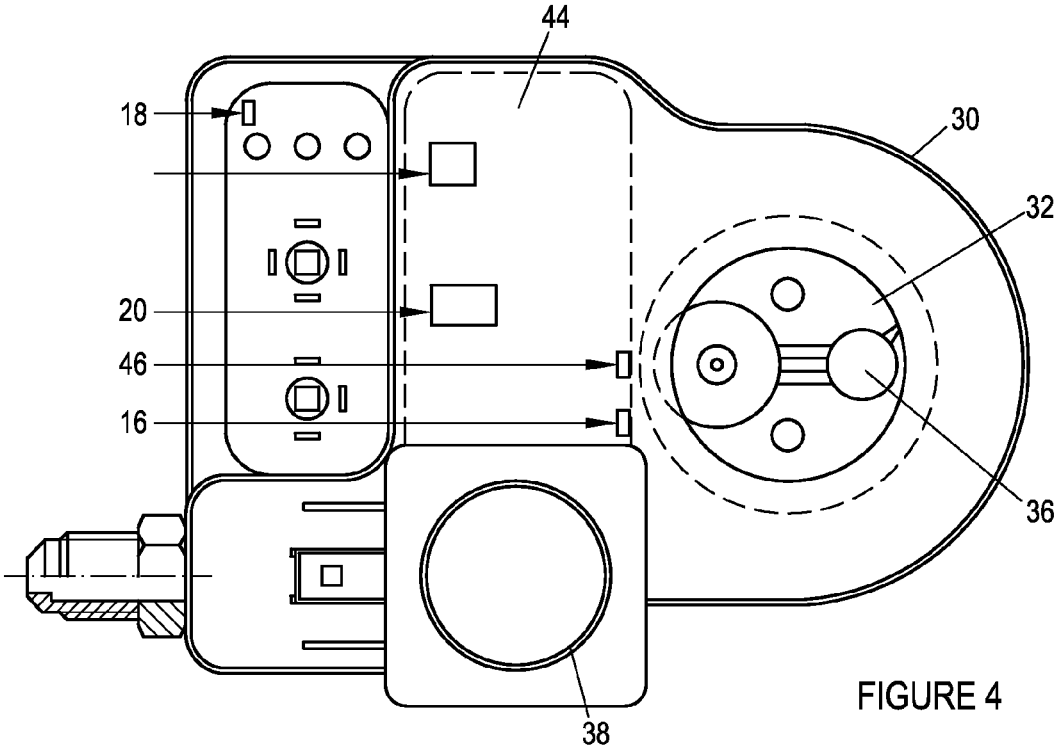

As previously mentioned, various components of the system 10 may be incorporated in an oil level measuring device 14. The device 14 comprises a body 30 made from a metallic material such as aluminum. The body 30 is mechanically and thermally coupled to the compressor 12 and in particular crank case 24. Moreover device 14 is placed at a level commensurate with the intended oil level within the crank case 24. While the specific operation of the device 14 is not critical to the present invention a brief description will be made of some of its features. The device 14 includes a chamber 32 into which oil from the crank case 24 can flow. A sight glass 34 is provided to enable viewing of the chamber 32 so that a visual inspection can be made of the oil level within compressor 12. A float mechanism 36 is also provided in the chamber 32 and connected with electronic signaling devices to provide an electronic indication of oil level within the compressor 12. The device 14 also comprises one or more solenoids 38 which control flow of oil into and out of the compressor 24 to maintain oil level within a prescribed range. The solenoid(s) 38 control flow through a fluid flow path 40 from an oil separator (not shown) into the crank case 24 and flow through a further flow path 42 of oil from compressor 12 to a sump (not shown). As shown in FIG. 4 the body 30 is also provided with a cavity 44 for housing electronic devices and circuits associated with the oil level measurement. However the device 14 is used to carry the sensors 16, 18, 26 and 30 and the controller 20. In particular the oil temperature sensor 16, controller 20 and compressor state sensor 26 which may be in the form of an accelerometer are retained within a cavity 44 of the body 30. The air temperature sensor 16 is also mounted on the body 30 but at a spaced location from the aforementioned components and in a manner thermally isolated from the body 30. This is to ensure that the air temperature sensor 16 senses the air temperature and not the temperature of the oil within the compressor 12 which ordinarily would be communicated by thermal conduction to the body 30 and thus the oil temperature sensor 18. Indeed in an alternate embodiment, the air temperature sensor 16 may be physically separated from the compressor 12 and body 30 to communicate ambient air temperature for example wirelessly or alternatively by wire to the controller 20.

The oil level measuring device 14 also includes a flow position sensor 46 which may for example be a hall sensor which provides an indication of the position of the float 36 which in turn is used to operate solenoid(s) 38 to control oil level within the compressor 12. However this is not a specific function of the oil management system 10. Nevertheless, it is envisaged that alternate embodiments of the system 10 may incorporate both oil level measurement and sensing as well as oil temperature management.

Now that an embodiment of the invention has been described in detail it will be apparent to those skilled in the relevant arts that numerous modifications and variations may be made without departing from the basic inventive concepts. For example the oil temperature sensor 18, compressor state sensor 26 and controller 20 may be incorporated in a dedicated housing which is thermally attached to the crank case 24 so that the oil temperature is communicated to the sensor 18. The air temperature sensor 16 may be supported by but thermally insulated from that housing or alternately may be totally separate from the housing and communicate air temperature wirelessly or via other communication means such as but not limited to a wire or fiber optic cable. The heater 26 may be located inside the crank case 24 or indeed outside the crank case but in thermal communication with the crank case. In this way the heater heats the crank case which in turn will heat the oil through natural thermal conduction. In yet a further variation the oil temperature sensor 18 may by itself be attached to the crank case 24 or indeed located inside the crank case 24 at a location where it will be immersed in the oil in the crank case. All such modifications and variations are deemed to be within the scope of the present invention the nature of which is to be determined from the above description and the appended claims. In a further embodiment the compressor state sensor 26 could be in the form of a refrigerant temperature sensing device arranged to sense temperature of refrigerant at a discharge side of the compressor. The refrigerant temperature sensor can be located inside or outside of compressor. In yet a further variation the controller 20 may be arranged to determine Tmin on the basis of a combination of any two or more Tsat, Tamb and a freely selected temperature Tfree where Tmin≥f(Tsat, Tamb, Tfree) where f(x,y,z) is the largest of x,y,z.

What is claimed is:

1. An oil management system for a compressor in a refrigeration system comprising:

a heater arranged to heat oil in a crank case of the compressor;

an oil temperature sensor located within the crank case of the compressor and measuring a temperature of the oil within the crank case of the compressor;

a pressure sensor which measures crank case pressure of the compressor; and, a controller operatively associated with the temperature sensor, the pressure sensor, and the heater, the controller arranged to:

calculate a saturation temperature (Tsat) of refrigerant used in the refrigeration system from the measured crank case pressure, determine a min temperature (Tmin) based on the saturation temperature (Tsat), the min temperature (Tmin) being greater than the saturation temperature (Tsat), and control operation of the heater on the basis of ambient air temperature and oil temperature to maintain the oil temperature measured by the oil temperature sensor within a range Tmax≥R≥Tmin where Tmax>Tmin, the control including:

disabling the heater when the ambient air temperature is above the range; and when the ambient air temperature is less than the min temperature (Tmin) and the oil temperature measured by the oil temperature sensor is within the range, beginning operation of the heater before the oil temperature measured by the oil temperature sensor becomes less than or equal to the min temperature (Tmin).

2. The oil management system according to claim 1 comprising an ambient air temperature sensor for measuring the ambient temperature (Tamb) and wherein the controller is operatively associated with the air temperature sensor and arranged to calculate Tmin further using Tamb.

3. The oil management system according to claim 1 wherein the controller is arranged to enable a user to input Tmin and Tmax under the constraint that Tmax>Tmin.

4. The oil management system according to claim 1 wherein the controller is arranged to control the heater only when the compressor is in an OFF state.

5. The oil management system according to claim 4 comprising a compressor state sensor operatively associated with the controller, the compressor state sensor arranged to sense an operational state of the compressor and deliver to the controller: an OFF state signal when the compressor is sensed as being in an OFF state, and an ON state signal when the compressor is sensed as being in the ON state.

6. The oil management system according to claim 5 wherein the compressor state sensor comprises a vibration transducer mechanically coupled to the crank case.

7. The oil management system according to claim 5 wherein the compressor state sensor comprises a refrigerant temperature sensing device to sense temperature of refrigerant at a discharge side of the compressor.

8. The oil management system according to claim 1 wherein the controller is arranged to calculate the saturation temperature (Tsat) of the refrigerant depending on the type of refrigerant used.

* * * * *